US009393598B2

(12) United States Patent
Cady et al.

(10) Patent No.: US 9,393,598 B2
(45) Date of Patent: Jul. 19, 2016

(54) COMPOSITE SCREEN FRAME WITH SEMI-FLEXIBLE MECHANICAL STRAIN RELIEF

(71) Applicant: M-I L.L.C., Houston, TX (US)

(72) Inventors: Eric Cady, Florence, KY (US); Bradley Jones, Crestview Hills, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 14/417,706

(22) PCT Filed: Jul. 29, 2013

(86) PCT No.: PCT/US2013/052487

§ 371 (c)(1),
(2) Date: Jan. 27, 2015

(87) PCT Pub. No.: WO2014/018961

PCT Pub. Date: Jan. 30, 2014

(65) Prior Publication Data

US 2015/0258575 A1 Sep. 17, 2015

Related U.S. Application Data

(60) Provisional application No. 61/676,888, filed on Jul. 27, 2012.

(51) Int. Cl.

| | |
|---|---|
| ***B07B 1/46*** | (2006.01) |
| ***B07B 1/04*** | (2006.01) |
| ***B07B 1/06*** | (2006.01) |
| ***B07B 1/28*** | (2006.01) |
| *B07B 1/40* | (2006.01) |

(52) U.S. Cl.

CPC ..... *B07B 1/4618* (2013.01); *B07B 1/04* (2013.01); *B07B 1/06* (2013.01); *B07B 1/28* (2013.01); *B07B 1/46* (2013.01); *B07B 1/40* (2013.01); *Y10T 29/49826* (2015.01)

(58) Field of Classification Search

CPC ..... B07B 1/46; B07B 1/4609; B07B 1/4618; B07B 2201/02

See application file for complete search history.

(56) References Cited

U.S. PATENT DOCUMENTS

| | | | | |
|---|---|---|---|---|
| 3,463,315 A * | 8/1969 | Blackwell | B07B 1/48 | 101/127.1 |
| 4,582,597 A | 4/1986 | Huber | | |
| 4,861,462 A * | 8/1989 | Lehmann | B01D 29/012 | 156/85 |
| 5,358,123 A * | 10/1994 | Stone | B07B 1/4618 | 209/403 |
| 6,269,954 B1 * | 8/2001 | Baltzer | B01D 33/0376 | 209/309 |

(Continued)

FOREIGN PATENT DOCUMENTS

WO 2006/002023 A2 1/2006

OTHER PUBLICATIONS

International Search Report and Written Opinion for corresponding PCT Application Serial No. PCT/US2013/052487, 10 pages.

*Primary Examiner* — Joseph C Rodriguez

(57) ABSTRACT

An apparatus and a method filters particles using a screen assembly with an inner section, an outer section and a screen material. The inner section and the outer section form an opening. The screen material is stretched across the opening and is supported by the inner section. The inner section is flexible relative to the outer section. When particles are introduced to the screen material, the inner section flexes to reduce strain on the screen material.

20 Claims, 3 Drawing Sheets

(56) References Cited

U.S. PATENT DOCUMENTS 6,543,621 B2 4/2003 Baltzer et al.
6,630,091 B2 * 10/2003 Mickelson ..... B07B 1/4618 264/273
6,672,460 B2 * 1/2004 Baltzer ..... B01D 33/0376 209/403
7,249,677 B2 7/2007 Cady et al.
7,258,717 B2 8/2007 Duffy
7,296,685 B2 * 11/2007 Malmberg ..... B07B 1/4609 209/405
7,810,649 B2 * 10/2010 Robertson ..... B01D 33/0093 209/401
8,469,199 B2 * 6/2013 Gronvall ..... B07B 1/4645 209/399
9,010,541 B2 * 4/2015 Anderson ..... B07B 1/28 209/405

* cited by examiner

COMPOSITE SCREEN FRAME WITH SEMI-FLEXIBLE MECHANICAL STRAIN RELIEF

BACKGROUND

Vibratory separators use a screen assembly to sort "oversized" particles from fluid or other particles. The screen assembly includes a wire or synthetic mesh screen material that is stretched across a frame. The frame has an interior edge that contacts the screen material. Product to be separated is introduced to the top surface of the screen material and the screen assembly is vibrated by the vibratory separator. Individual wires in the screen material near the edge of the frame are strained by the weight of the product to be separated. Additionally, the individual wires are further strained by the vibration of the frame. The strain on each individual wire varies around the interior edge of the frame. Once one of the individual wires breaks under the strain, nearby individual wires are placed under greater strain. The damage to the screen material often widens across several individual wires.

The frame is made of steel, thermoset or rigid composite thermoplastic. The screen material is attached to a steel frame by spot welding or by using an adhesive. The screen material is attached to a thermoset frame by using an adhesive. For either attachment method, strain relief is provided at the interface of the screen material and the interior edge of the frame. A bead of silicone or other caulking-type of elastomer bead is manually applied to the frame to provide strain relief to the screen material.

The screen material is attached to rigid composite thermoplastic frames by heating the thermoplastic material and then pressing the mesh into the soft thermoplastic, which is then allowed to cool. Existing composite frame includes an internal mesh support grid that utilizes valuable sorting area, leaving less area for processing.

Improved screen assemblies having a rigid support section formed from a polymeric material and a cushioned strain relief zone have been proposed. See U.S. Pat. No. 7,249,677. In the prior screen assembly, the cushioned strain relief zone extends along an inner peripheral wall of the rigid support section around an opening to provide a cushioned support to the edge of a screen cloth extending across the opening. The rigid support section and the cushioned strain relief zone are made of different materials. Each material has a different hardness. In particular, the material forming the rigid support section is harder than the material forming the strain relief zone.

DETAILED DESCRIPTION

In the development of an embodiment of the present disclosure, numerous implementation-specific decisions can be made to achieve the developer's specific goals, such as compliance with system related and business related constraints, which may vary from one implementation to another. Moreover, such a development effort might be complex and time consuming but would nevertheless be a routine undertaking for those of ordinary skill in the art having the benefit of this disclosure. In addition, the composition used/disclosed herein can also comprise some components other than those cited. Each numerical value should be read once as modified by the term "about" (unless already expressly so modified), and then read again as not so modified unless otherwise indicated in context. Also a range listed or described as being useful, suitable, or the like, is intended to include any value within the range, including the end points, and is to be considered as having been stated. For example, "a range of from 1 to 10" is to be read as indicating each possible number along the continuum between about 1 and about 10. Thus, even if specific data points within the range, or even no data points within the range, are explicitly identified or refer to a few specific, it is to be understood that the inventors appreciate and understand that any data points within the range are to be considered to have been specified, and that inventors possessed knowledge of the entire range and the points within the range.

The disclosure relates to a screen assembly 100 for a shaker or separator, such as a vibratory separator (not shown). The screen assembly 100 may be used for a variety of purposes in the food, chemical and paper industries. As another example, the screen assembly 100 may be used in the drilling industry, such as for removing cuttings from oilfield drilling fluid, and sifting sand for hydraulic fracturing.

Figure 1:
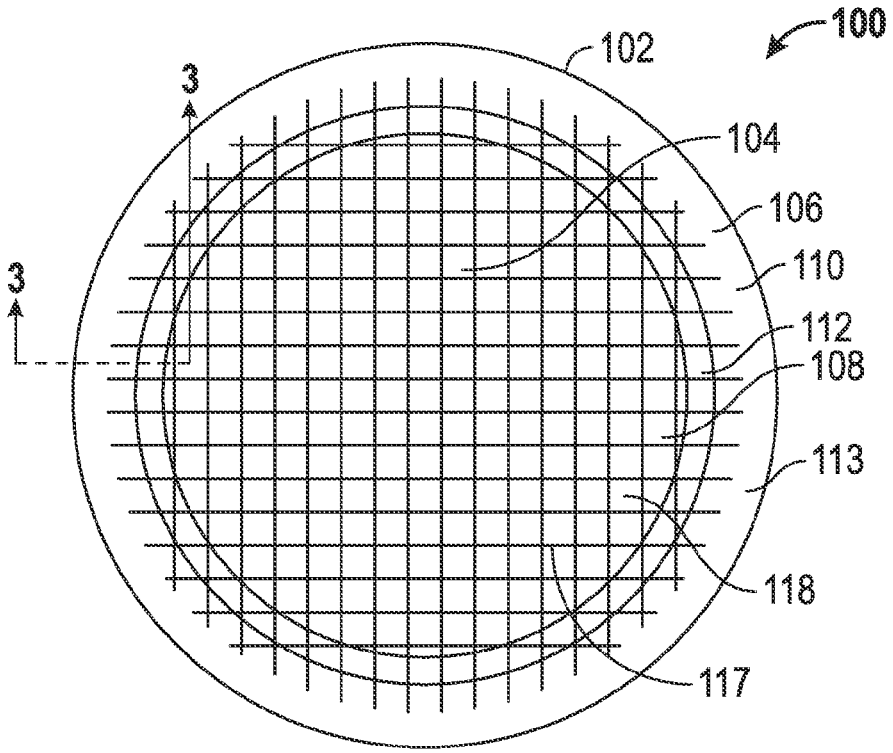
FIG. 1 illustrates a top view of a screen assembly in accordance with an embodiment of the present disclosure with a screen frame and a screen material secured to the screen frame.
Figure 2:
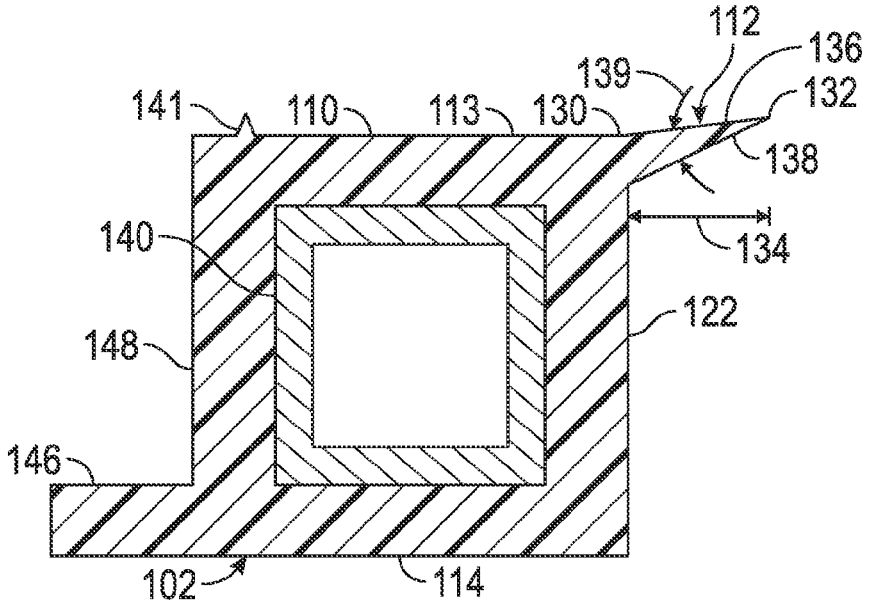
FIG. 2 illustrates a cross sectional view of an embodiment of the screen frame of FIG. 1 taken along the lines 3-3.

Referring to FIGS. 1 and 2, the screen assembly 100 may have screen material 104 stretched across a screen frame 102. The screen frame 102 may have a peripheral frame 106 which may define an opening 108. The peripheral frame 106 may partially or completely surround the opening 108.

The screen frame 102 may have an outer section 110 and an inner section 112. The screen frame 102 may be configured to be secured within the vibratory separator and may be designed to support the screen material 104 to withstand forces applied to the screen frame 102 and the screen material 104. In an embodiment, the screen frame 102 may be a unitary structure with the outer section 110 surrounding and being integrally formed with the inner section 112. The outer section 110 of the screen frame 102 may be configured to be secured within the vibratory separator and may provide a rigid support for the screen frame 102 and the screen material 104. The inner section 112 may flex relative to the outer section 110 and may support the screen material 104 stretched across the opening 108. The inner section 112 may act as a shock absorber for the screen material 104 and may reduce fatigue or failure of the screen material 104 when the screen assembly 100 is used by the vibratory separator.

The screen frame 102 may also have a top surface 113 extending across and formed by the inner section 112 and the outer section 110 of the screen frame 102. The top surface 113 may attach to the screen material 104 and may also support the screen material 104 in a manner that reduces fatigue or failure of the screen material 104. When the screen material 104 is secured to the top surface 113, the screen material 104 may extend across the inner section 112 and at least a portion of the outer section 110. The inner section 112 may be positioned at the interface of the top surface 113 and the screen material 104 and may dampen vibrational energy affecting the screen material 104 as the screen assembly 100 is vibrated. The screen material 104 may be attached to the outer section 110. The outer section 110 of the screen frame 102 may also have a bottom surface 114 generally opposite to the top surface 113.

Figure 3:
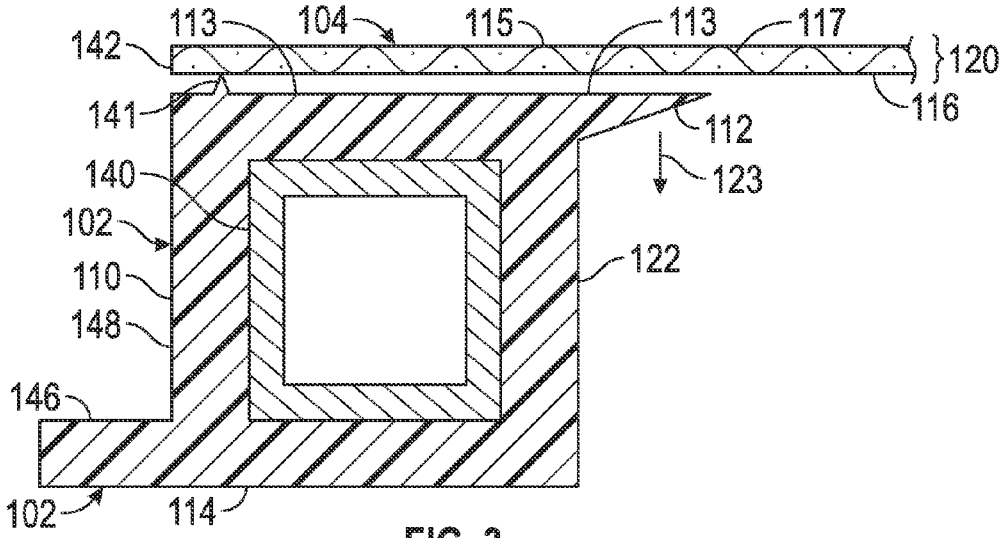
FIG. 3 illustrates a cross sectional view taken along the lines 3-3 in FIG. 1 showing an embodiment of the screen frame with the screen material.

As shown in FIG. 3, the screen material 104 may have a top surface 115 and a bottom surface 116. The screen material 104 may sift and/or separate material having different sizes by permitting product under a predetermined size to pass through the screen material 104 from the top surface 115 to the bottom surface 116. Additionally, the screen material 104 may prevent product over the predetermined size from passing through the screen material 104. The screen material 104 may be made of one or more substances 117 having openings 118. In an embodiment, the substance 117 may be formed by a synthetic mesh having the openings 118. In another embodiment, the substance 117 may be formed by a plurality of interwoven wires defining the openings 118. The substances 117 are not limited to these embodiments. The substances 117 may be made of any material that may be define openings 118. The screen material 104 shown in FIG. 3 has one layer 120 of the substance 117. However, the screen material 104 may have one or more layers 120.

The screen material 104 shown in FIG. 3 may be secured to the outer section 110 of the screen frame 102 such that the bottom surface 116 engages and is supported by the inner section 112. The inner section 112 may flex to provide cushioned support to the screen material 104 when the product is applied to the top surface 115 of the screen material 104 and may extend the life of the screen material 104. When the product is applied to the top surface 115 of the screen material 104, the screen material 104 may be pulled downward from the top surface 113 of the screen frame 102 towards the bottom surface 114. The inner section 112 may flex in a direction 123 toward the bottom surface 114 and may dampen the energy associated with the product falling on the top surface 115 of the screen material 104. The inner section 112 may also distribute strain across the screen material 104 to reduce fatigue on the screen material 104.

The screen material 104 may attach to the screen frame 102 to form the screen assembly 100. For example, the screen material 104 may attach to the screen frame 102 by hot plate welding or sonic welding. The screen frame 102 may include one or more ridges 141 on the top surface 113. The screen material 104 may be bonded to the ridges. The ridges 141 may extend upwardly from the top surface 113 of the outer section 110 of the screen frame 102. The ridges 141 may provide material sufficient to secure the screen material 104 to the outer section 110. For example, to attach the screen material 104 to the top surface 113, a peripheral edge 142 (FIG. 3) of the screen material 104 may be tightened to apply tension to the screen assembly 100. The ridges 141 may be heated to melt a portion of the ridges 141 to allow the screen material 104 to be embedded within the ridges 141. Upon cooling, the screen material 104 may be adjoined to the screen frame 102. Grooves (not shown) in the top surface 113 of the outer section 110 may receive excess melted material from the ridges 141 when the screen material 104 is secured to the screen frame 102.

The outer section 110 formed from the thermoset material may have the screen material 104 adhered to the top surface 113 of the outer section 110 of the screen frame 102. An adhesive and/or epoxy may be used to attach the screen material 104 to the outer section 110 of the screen frame 102.

The outer section 110 and the inner section 112 of the screen frame 102 may be formed from a polymeric material, such as polypropylene. The material forming the outer section 110 and the inner section 112 may be filled with reinforcement particles, such as talc or fiberglass. The outer section 110 may be shaped to provide rigidity and support to the screen frame 102. The inner section 112 may be shaped to provide flexing of the inner section 112 towards the bottom surface 114 (as shown by arrow 123) and may provide mechanical strain relief to the screen material 104. Providing mechanical strain relief may act as a shock absorber for the screen material 104 and may extend the life of the screen material 104. When the outer section 110 and the inner section 112 are formed of the same material, a rebound hardness of the outer section 110 and the inner section 112 may be the same.

The rebound hardness may be measured by determining a height of a "bounce" of a diamond-tipped hammer dropped from a fixed height onto a material. The rebound hardness is related to elasticity. A device used to take this measurement is known as a scleroscope. Two scales that measure rebound hardness are the Leeb rebound hardness test and Bennett hardness scale.

The outer section 110 and the inner section 112 of the screen frame 102 may be formed by molding material in a process using a mold to form the outer section 110 and the inner section 112. For example, the inner section 112 may be co-molded with the outer section 110, which may occur in a one-shot molding process. The outer section 110 and the inner section 112 may be constructed of any material that may be molded. The material may provide resiliency and/or flexibility to the inner section 112 to cushion the screen material 104 and may extend the life thereof. For example, the outer section 110 and the inner section 112 of the screen frame 102 may be molded from a polymer material, such as polypropylene. The process may be any type of molding process suitable for forming the outer section 110 and the inner section 112 such that the outer section 110 and the inner section 112 are formed of the same material. Additionally, the process may form the outer section 110 and the inner section 112 from different materials having the same or similar hardnesses.

In an embodiment, the outer section 110 and the inner section 112 may be formed by a milling process from a block of material or an extrusion process. When the extrusion process is used, the screen frame 102 may be formed by interconnecting one or more segments with each segment having the outer section 110 and the inner section 112.

In the example shown in FIG. 2, the inner section 112 may surround the opening 108 within the screen frame 102 and may extend beyond the inner edge 122 of the outer section 110. The inner section 112 may surround the opening 108. The inner section 112 may partially and/or intermittently surround the opening 108. The inner section 112 may have a first end 130, a second end 132 and a length 134 extending between the first end 130 and the second end 132. The first end 130 may be connected to the outer section 110, and the second end 132 may extend beyond the inner edge 122 and may define a perimeter of the opening 108.

To permit the inner section 112 to flex relative to the outer section 110, the inner section 112 may be tapered from the first end 130 to the second end 132. The inner section 112 has an upper surface 136 and a lower surface 138 which may have a planar shape providing a triangular and/or tapered cross-sectional area to the inner section 112. However, the upper surface 136 and the lower surface 138 may have any suitable shape. For example, the upper surface 136 and/or the lower surface 138 may have an arcuate shape or a combination of arcuate shapes and planar shapes so that the inner section 112 may be flexible relative to the outer section 110 and may provide the mechanical strain relief to the screen material 104.

When the inner section is tapered from the first end 130 to the second end 132, the upper surface 136 and the lower surface 138 may meet at an acute angle 139. The acute angle 139 may be any suitable angle, such as less than 90 degrees, and may be in a range between 1 degree and 20 degrees.

Referring to FIG. 2, the screen frame 102 may include a reinforcement member 140 encapsulated within the outer section 110 and may extend around the opening 108. The reinforcement member 140 may be a metal tube attached to and formed into the outer section 110 of the screen frame 102. The reinforcement member 140 may provide rigidity to the screen frame 102. One of skill in the art will appreciate that any material that provides rigidity may be used to form the reinforcement member 140, including metal and polymer composite materials.

As shown in FIG. 3, when the screen material 104 is affixed to the top surface 113, the inner section 112 may be compressed to provide support to the screen material 104 around the opening 108 defined by the screen frame 102. As the product is applied to the top surface 115 of the screen material 104, the inner section 112 may flex to prevent localized strain on the screen material 104.

Referring again to FIG. 2, the screen frame 102 may include a flange 146 extending outward from the outer section 110. The flange 146 may extend outwardly from the outer section 110 along the bottom surface 114. The bottom surface 114 may be substantially parallel to the top surface 113, and the inner edge 122 may extend between the inner section 112 and the bottom surface 114. The flange 146 may be located on an outer edge 148 of the outer section 110 opposing the inner edge 122 and may be used to retain the screen assembly 100 within the vibratory separator (not shown). A gasket may be used to seal the interface between the separator components and the flange 146.

Figure 4:
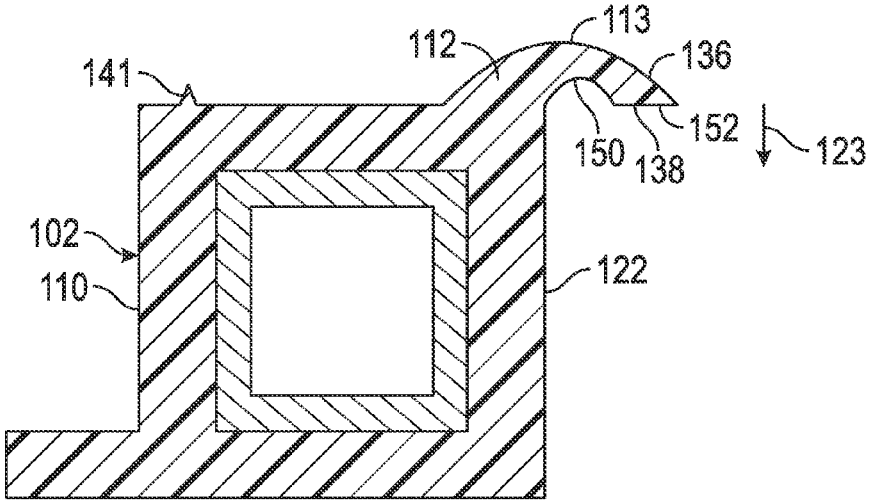
FIG. 4 illustrates a cross sectional view of an embodiment of the screen frame with an arcuately shaped inner section which extends upwardly from a top surface of the screen frame.
Figure 5:
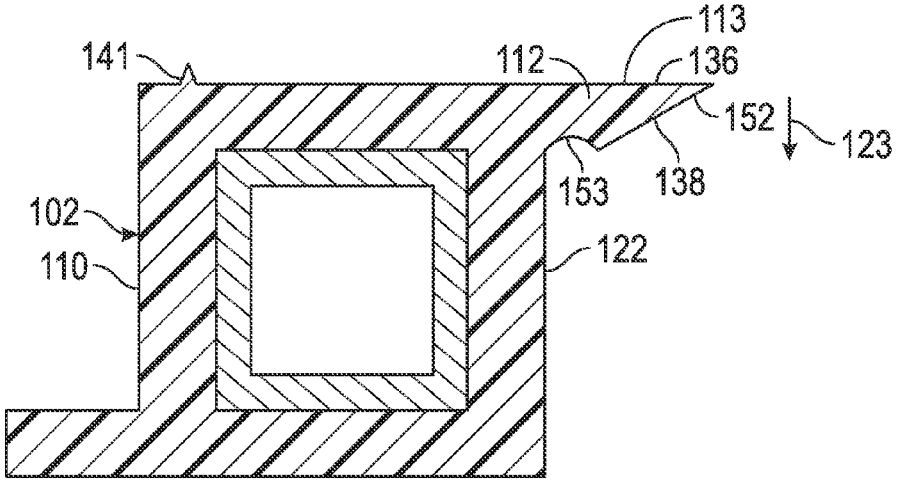
FIG. 5 illustrates a cross sectional view of an embodiment of the screen frame with a lower surface of the inner section shaped to form a hinge.

The inner section 112 and the outer section 110 may have different embodiments, as shown in FIGS. 4 and 5. In an embodiment shown in FIG. 4, the inner section 112 may extend upwardly from the top surface 113 and beyond the inner edge 122. The upper surface 136 may have an arcuate shape. The lower surface 138 may have an arcuate portion 150 and a planar portion 152. The arcuate portion 150 may form a hinge to permit flexing of the inner section 112 in the direction 123. The arcuate shape of the upper surface 136 may reduce binding of the substance 117 to prevent localized strain.

In an embodiment shown in FIG. 5, the upper surface 136 of the inner section 112 may extend outwardly from the outer section 110 and may form a flat surface with the top surface 113. The lower surface 138 of the inner section 112 may have a notch 153 and the planar portion 152. The notch 153 may form a hinge to permit flexing of the inner section 112 in the direction 123 when force is applied to the upper surface 136. The planar portion 152 and the upper surface 136 may form an acute angle at the second end 132, and a tapered portion may extend to the notch 153 from the second end 132.

Figure 6:
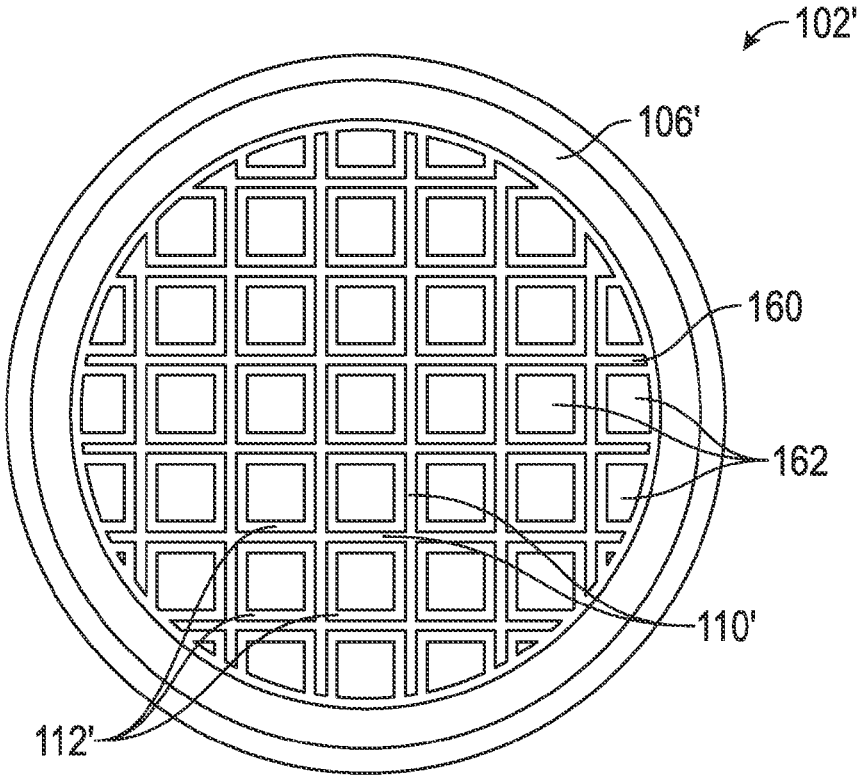
FIG. 6 illustrates a top view of an embodiment of the screen frame with a circular shape and a plurality of openings.

An embodiment of the screen frame 102' is shown in FIG. 6. The screen frame 102' may include a peripheral frame 106' and an internal support frame 160. The internal support frame 160 may be formed with and may be contiguous with the peripheral frame 106' to create a plurality of cells 162 within the screen frame 102'. The screen material 104 may be secured to the peripheral frame 106' and/or the internal support frame 160.

As the product is applied to the top surface 115 of the screen material 104 over each opening 162 defined by the internal support frame 160, the screen material 104 along the internal support frame 160 is strained. The internal support frame 160 includes an outer section 110' and inner sections 112' that are identical in construction and function as the outer section 110 and the inner section 112 described above. Thus, each of the cells 162 defined by the internal support frame 160 has an inner section 112' around its periphery. Such a configuration may be desirable when it is anticipated that the screen material 104 may be subjected to heavy loads.

One of skill in the art will appreciate that configurations such as those already described for the inner section 112 and outer section 110 with respect to the screen frame 102 are applicable to the internal support frame 160. Reinforcement rods (not shown) may be included within the outer section 110' of the internal support frame 160.

One of skill in the art will further appreciate that other configurations of an internal support frame 160 are possible having the outer section 110' and the inner section 112'. For example, the cells 162 may be circular.

Figure 7:
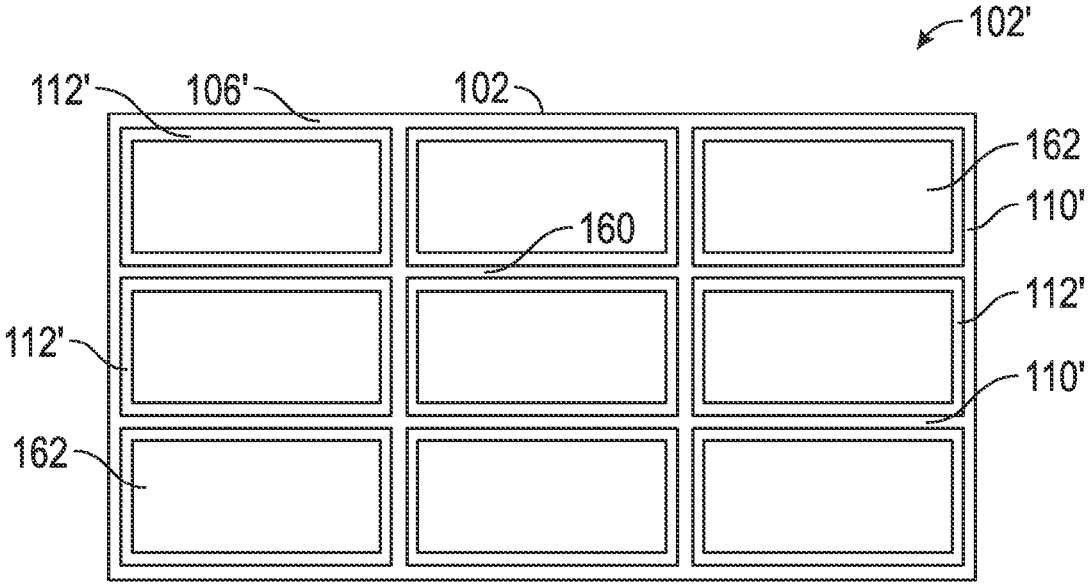
FIG. 7 illustrates a top view of an embodiment of the screen frame with a rectangular shape and a plurality of openings.

One of skill in the art will further appreciate that the described screen frame 102' may be rectangular in shape, as shown in FIG. 7. The screen frame 102' may have a peripheral frame 106' with or without an internal support frame 160. In this embodiment, the screen frame 102' may include an outer section 110' and an inner section 112' around each opening 162 within the screen frame 102'.

While the disclosure has been described with respect to a limited number of embodiments, those skilled in the art, having benefit of this disclosure, will appreciate that other embodiments can be devised which do not depart from the scope of the claimed subject matter as disclosed herein. For example, anti-bacterial additives may be used in the material forming the screen frames 102 and 102'.

The preceding description has been presented with reference to some embodiments. Persons skilled in the art and technology to which this disclosure pertains will appreciate that alterations and changes in the described structures and methods of operation can be practiced without meaningfully departing from the principle, and scope of this application. Accordingly, the foregoing description should be read as consistent with and as support for the following claims, which are to have their fullest and fairest scope.

The scope of patented subject matter is defined by the allowed claims. Moreover, the claim language is not intended to invoke paragraph six of 35 USC §112 unless the exact words "means for" are used.

The invention claimed is:

1. An apparatus comprising:

a screen frame having an inner section and an outer section, the inner section and the outer section defining an opening, the outer section having an innermost edge defining at least a portion of the opening, wherein the inner section comprises a first end and a second end with a length extending between the first end and the second end, wherein the second end of the inner section extends inwardly beyond the innermost edge of the outer section, the inner section and the outer section being integrally formed from a polymeric material wherein a portion of the inner section flexes downwardly with respect to the outer section; and a screen material stretched across the opening and secured to the outer section of the screen frame wherein the inner section supports the screen material at least partially around the opening.

2. The apparatus of claim 1 further comprising:

a reinforcement member encapsulated within the outer section.

3. The apparatus of claim 1 wherein the inner section of the screen frame has a first hardness and the outer section of the screen frame has a second hardness wherein the first hardness is equal to the second hardness.

4. The apparatus of claim 1 wherein the inner section has a convex upper surface extending upwardly and a lower surface with a concave portion and a planar portion wherein the concave portion permits the inner section to flex wherein the screen material is supported by the upper portion of the inner section.

5. The apparatus of claim 1 wherein the inner section further comprises a notch between the first end and the second end wherein the notch permits the second end of the inner section to flex relative to the first end of the inner section upon application of force to the second end.

6. The apparatus of claim 1 wherein the screen frame is circular.

7. The apparatus of claim 1 wherein the screen frame is rectangular.

8. The apparatus of claim 1 further comprising:

an internal support frame within the opening of the screen frame wherein the internal support frame defines a plurality of cells wherein the internal support frame supports the screen material.

9. The apparatus of claim 1 wherein the internal support frame has a plurality of inner sections extending into the plurality of cells.

10. A method comprising:

forming an outer section and an inner section of a screen frame from a single material, the inner section and the outer section having the same hardness, with the outer section and the inner section extending around an opening, the inner section connected to the outer section, the inner section defining the opening in the screen frame wherein the screen frame has a top surface; and applying a screen material on the top surface of the screen frame such that the screen material extends across the opening and is supported by the inner section wherein a portion of the inner section flexes downwardly relative to the outer section in response to a force on the screen material.

11. The method of claim 10 further comprising:

preparing a mold to form the outer section and the inner section as a unitary structure.

12. The method of claim 10 further comprising:

melting a portion of the top surface of the screen frame to adhere the screen material to the top surface of the screen frame.

13. The method of claim 10 further comprising:

welding the screen material to the top surface of the screen frame.

14. The method of claim 10 further comprising:

forming the outer section and the inner section of the screen frame around a reinforcement member.

15. The method of claim 10 further comprising:

adding reinforcement particles to the material prior to forming the outer section and the inner section.

16. The method of claim 10 further comprising:

tightening the screen material prior to securing the screen material to the outer section.

17. An apparatus comprising:

a screen frame having an opening, an outer section and an inner section extending around at least a portion of the opening, the inner section being integrally formed with the outer section, the screen frame having a top surface formed by the outer section and the inner section, wherein the inner section extends upwardly from the top surface and beyond an innermost edge of the outer section, the outer section having a first rebound hardness, the inner section having a second rebound hardness where the first rebound hardness equals the second rebound hardness; and a screen material extending across the opening and the inner section, the screen material secured to the outer section and supported by the inner section adjacent the opening.

18. The apparatus of claim 17 wherein the outer section has an inner edge surrounding the opening and further wherein the inner section extends inwardly beyond the inner edge of the outer section.

19. The apparatus of claim 17 wherein the inner section and the outer section of the screen frame are formed from a single material.

20. The apparatus of claim 19 wherein reinforcement particles are incorporated into the material.

* * * * *